US006095082A

United States Patent [19]

Belt et al.

[11] Patent Number: 6,095,082

[45] Date of Patent: Aug. 1, 2000

[54] APPARATUS FOR APPLYING GRANULES TO AN ASPHALT COATED SHEET TO FORM A PATTERN HAVING INNER AND OUTER PORTIONS

[75] Inventors: James S. Belt, Utica; Frank R. Wilgus, Powell; Frank A. Wilgus, Westerville, all of Ohio

[73] Assignee: Owens Corning Fiberglas Technology, Inc., Summit, Ill.

[21] Appl. No.: 09/052,738

[22] Filed: Mar. 13, 1998

Related U.S. Application Data

[62] Division of application No. 08/781,898, Dec. 30, 1996, Pat. No. 5,766,678.

[51] Int. Cl.[7] ..... B05B 7/26

[52] U.S. Cl. ..... 118/308; 118/310; 118/311; 118/627

[58] Field of Search ..... 118/308, 310, 118/315, 324, 627, 311; 222/145.1, 145.8; 239/424, 601, 522, 687; 198/562–569

[56] References Cited

U.S. PATENT DOCUMENTS

| | | |
|---|---|---|
| D. 83,718 | 3/1931 | Brown . |
| D. 89,471 | 3/1933 | Streeter et al. . |
| D. 93,191 | 8/1934 | Topping . |
| 978,333 | 12/1910 | Overbury . |
| 1,295,360 | 2/1919 | Overbury . |
| 1,345,627 | 7/1920 | Overbury . |
| 1,445,991 | 2/1923 | Butterick . |
| 1,583,563 | 5/1926 | Abraham . |
| 1,820,005 | 8/1931 | Maclean . |
| 1,900,598 | 3/1933 | Doyan . |
| 1,925,541 | 9/1933 | Noble . |
| 1,956,285 | 4/1934 | Harshberger . |
| 2,111,761 | 3/1938 | Eckert . |
| 2,129,288 | 9/1938 | Shattuck . |
| 2,175,226 | 10/1939 | Slayter . |
| 2,211,204 | 8/1940 | Hall . |
| 2,316,093 | 4/1943 | MacNutt . |
| 2,348,223 | 5/1944 | Papesh . |
| 2,523,759 | 9/1950 | Grant . |
| 2,676,155 | 4/1954 | Farris . |
| 2,771,387 | 11/1956 | Kleist et al. . |
| 3,266,671 | 8/1966 | Gelpey . |
| 3,332,830 | 7/1967 | Tomlinson et al. . |
| 3,919,823 | 11/1975 | Bradley . |
| 4,233,100 | 11/1980 | Cunningham et al. . |
| 4,263,346 | 4/1981 | Sandell . |
| 4,274,243 | 6/1981 | Corbin et al. . |
| 4,333,279 | 6/1982 | Corbin et al. . |
| 4,359,873 | 11/1982 | Miller . |
| 4,399,186 | 8/1983 | Lauderback . |
| 4,468,430 | 8/1984 | Ruede . |
| 4,583,486 | 4/1986 | Miller . |
| 5,080,259 | 1/1992 | Hadley . |
| 5,186,980 | 2/1993 | Koschitzky . |
| 5,405,647 | 4/1995 | Grubka et al. . |
| 5,488,807 | 2/1996 | Terrenzio et al. . |
| 5,520,889 | 5/1996 | Burton . |
| 5,547,707 | 8/1996 | Haubert et al. . |

FOREIGN PATENT DOCUMENTS

| | | |
|---|---|---|
| 0 586 257 | 9/1994 | European Pat. Off. . |
| 586257 | 9/1994 | European Pat. Off. . |

OTHER PUBLICATIONS

The Ruberoid Company, "Instructions For Laying 11×32 Inch Strip–Shingles in Varied Designs", dated 1921.

*Primary Examiner*—Fred J. Parker

*Attorney, Agent, or Firm*—Inger H. Eckert; James J. Dottavio

[57] ABSTRACT

In a method of forming a pattern of granules on a moving asphalt coated sheet, a blend drop of first and second granules is discharged onto the sheet. The blend drop forms a granule deposit on the sheet including an inner portion of first granules and an outer portion of second granules. An apparatus for use in the method includes a nozzle having an orifice for discharging a blend drop of first and second granules onto the sheet. A first granule feed chamber is provided for feeding first granules into the nozzle. A second granule feed chamber is provided for feeding second granules into the nozzle. The first and second granule feed chambers are positioned so that the first granules are fed inside the second granules in the nozzle.

14 Claims, 4 Drawing Sheets

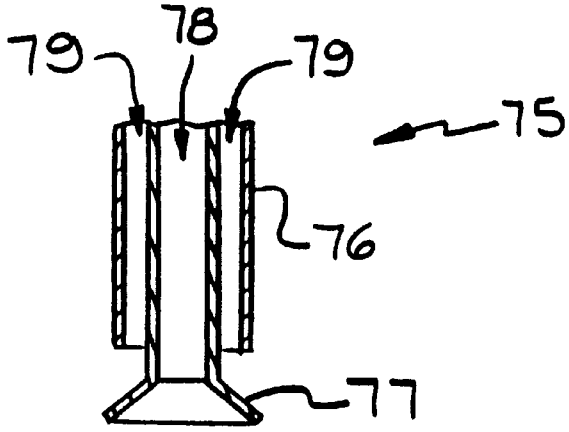
FIG. 8
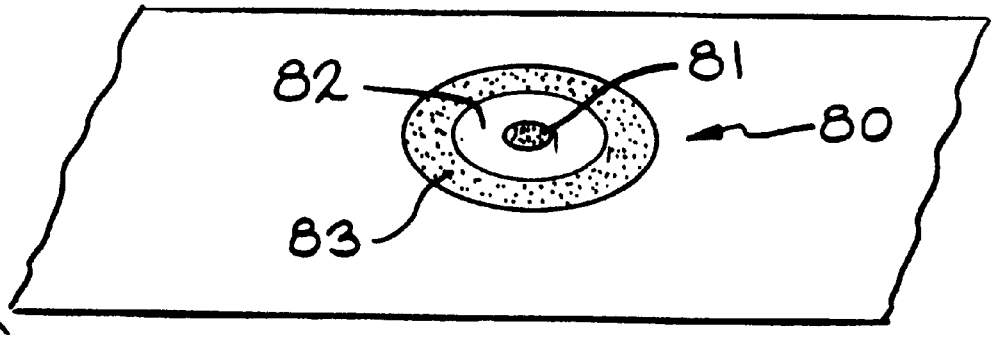

APPARATUS FOR APPLYING GRANULES TO AN ASPHALT COATED SHEET TO FORM A PATTERN HAVING INNER AND OUTER PORTIONS

This is a division of U.S. patent application Ser. No. 08/781,898, filed Dec. 30, 1996, now U.S. Pat. No. 5,766, 678.

CROSS-REFERENCE TO RELATED APPLICATIONS

This application is related to the following commonly filed and copending applications: U.S. application Ser. No. 08/774,432, filed Dec. 30, 1996, now U.S. Pat. No. 5,795, 622 entitled "Method of Rotating or Oscillating a Flow of Granules to Form a Pattern on an Asphalt Coated Sheet", by Belt et al.,; and U.S. application Ser. No. 08/774,433, filed Dec. 30, 1996, now U.S. Pat. No. 5,776,541 entitled "Method and Apparatus for Forming an Irregular Pattern of Granules on an Asphalt Coated Sheet", by Belt et al.,

TECHNICAL FIELD AND INDUSTRIAL APPLICABILITY

This invention relates in general to the handling of continuous sheets of asphalt material, such as asphalt material suitable for use as roofing shingles and roll roofing. More particularly, this invention relates to a method of discharging a blend drop of first and second granules onto an asphalt coated sheet to form a pattern having an inner portion of first granules and an outer portion of second granules.

BACKGROUND OF THE INVENTION

A common method for the manufacture of asphalt shingles is the production of a continuous sheet of asphalt material followed by a shingle cutting operation which cuts the material into individual shingles. In the production of asphalt sheet material, either a glass fiber mat or an organic felt mat is passed through a coater containing hot liquid asphalt to form a tacky, asphalt coated sheet. Subsequently, the hot asphalt coated sheet is passed beneath one or more granule applicators which discharge protective surface granules onto portions of the asphalt sheet material.

In the manufacture of colored shingles, two types of granules are typically employed. Headlap granules are granules of relatively low cost used for the portion of the shingle which will be covered up on the roof. Colored granules or prime granules are of relatively higher cost and are applied to the portion of the shingle which will be exposed on the roof.

To provide a color pattern of pleasing appearance, the colored portion of the shingles may be provided with areas of different colors. Usually the shingles have a background color and a series of granule deposits of different colors or different shades of the background color. The term "blend drop", as used herein, refers to the flow of granules of different colors or different shades of color that are discharged from a granule applicator toward the asphalt coated sheet. The term "granule deposit", as used herein, refers to the blend drop of granules after it has been deposited on the sheet.

A common method for manufacturing the shingles is to discharge blend drops onto spaced areas of the tacky, asphalt coated sheet. Background granules are then discharged onto the sheet and adhere to the tacky, asphalt coated areas of the sheet between the granule deposits formed by the blend drops.

One of the problems with typical granule application equipment is that it depends on mechanical movement to discharge blend drops onto the moving asphalt coated sheet. Usually the granules are fed from a hopper onto a fluted roll from which, upon rotation, the granules are discharged onto the sheet. The roll is ordinarily driven by a drive motor, and the roll is positioned in the drive or non-drive position by means of a brake-clutch mechanism. The requirement for mechanical action has inherent limitations which prevent a very precise beginning and ending to the blend drop. Also, once the mechanical action takes place, there is a short time lag as gravity takes effect on the granules and they drop onto the moving asphalt coated sheet. Consequently, there is a limit to the sharpness of the granule deposits on the shingle. As shingle manufacturing lines go up in speed, the lack of sharpness is accentuated and the distinction between the granule deposits and the background color becomes fuzzy. The lack of sharpness puts a severe limitation on the kinds of patterns and color contrasts which can be applied to shingles at high production speeds.

One method for manufacturing shingles having sharply defined granule deposits involves the application of the background color granules over the entire exposed tacky surfaces of the shingles. Adhesive such as hot asphalt is then applied in a pattern on top of the background color granules on the sheet, in the areas where the granule deposits are to be applied. Then the granule deposits are applied and adhere to the shingle only on the areas of adhesive. This method of applying granules is described in U.S. Pat. No. 4,352,837, issued Oct. 5, 1982 to Kopenhaver. Unfortunately, the application of the double layer of granules in the areas of granule deposits make these shingles relatively expensive, heavy and inflexible.

A recently developed improved method for discharging blend drops onto the moving asphalt coated sheet uses an apparatus known as a pneumatic blender. This apparatus employs a pneumatic gating mechanism to provide a relatively high degree of precision in discharging the blend drops. The flow of granules is started, stopped and controlled by providing pneumatic pressure changes in a buffer chamber positioned adjacent an accumulation of granules in a granule nozzle. When the pneumatic pressure is increased, the flow of granules is ejected under pressure onto the moving asphalt coated sheet instead of dropping solely by gravity. These features of the pneumatic blender allow more sharply defined granule deposits to be formed on the moving asphalt coated sheet. A preferred pneumatic blender is disclosed in U.S. Pat. No. 5,520,889, issued May 28, 1996 to Burton et al. (incorporated by reference herein).

Other improvements have also been made in methods of applying granule deposits. For example, U.S. Pat. No. 5,405,647, issued Apr. 11, 1995 to Grubka et al., discloses a method for applying granules to a moving asphalt coated sheet to form areas having sharp leading and trailing edges. However, it would still be desirable to provide a method for making a variety of unique and attractive patterns of granule deposits on asphalt coated sheets. Granule deposits applied by typical methods are usually formed of a single color or color blend of granules. Typical granule deposits also come in a limited variety of shapes. Thus, it would be desirable to provide a method and apparatus for forming granule deposits from two or more separate colors of granules. It would also be desirable to provide a method and apparatus for forming granule deposits having unique shapes, and for allowing the shapes to be easily changed on different shingles. These advantages should be provided without the drawbacks of applying a double layer of granules on the shingles.

SUMMARY OF THE INVENTION

The above objects as well as other objects not specifically enumerated are achieved by a method of forming a pattern of granules on a moving asphalt coated sheet. In the method, a blend drop of first and second granules is discharged onto the sheet. The blend drop forms a granule deposit on the sheet including an inner portion of first granules and an outer portion of second granules. An apparatus for use in the method includes a nozzle having an orifice for discharging a blend drop of first and second granules onto the sheet. A first granule feed chamber is provided for feeding first granules into the nozzle. A second granule feed chamber is provided for feeding second granules into the nozzle. The first and second granule feed chambers are positioned so that the first granules are fed inside the second granules in the nozzle.

BRIEF DESCRIPTION OF THE DRAWINGS

FIG. 8 is a cross-sectional view of an alternate embodiment of a nozzle and a deflector of a granule applicator, and a perspective view of a granule deposit produced using the granule applicator.

DETAILED DESCRIPTION AND PREFERRED EMBODIMENTS

Figure 1:
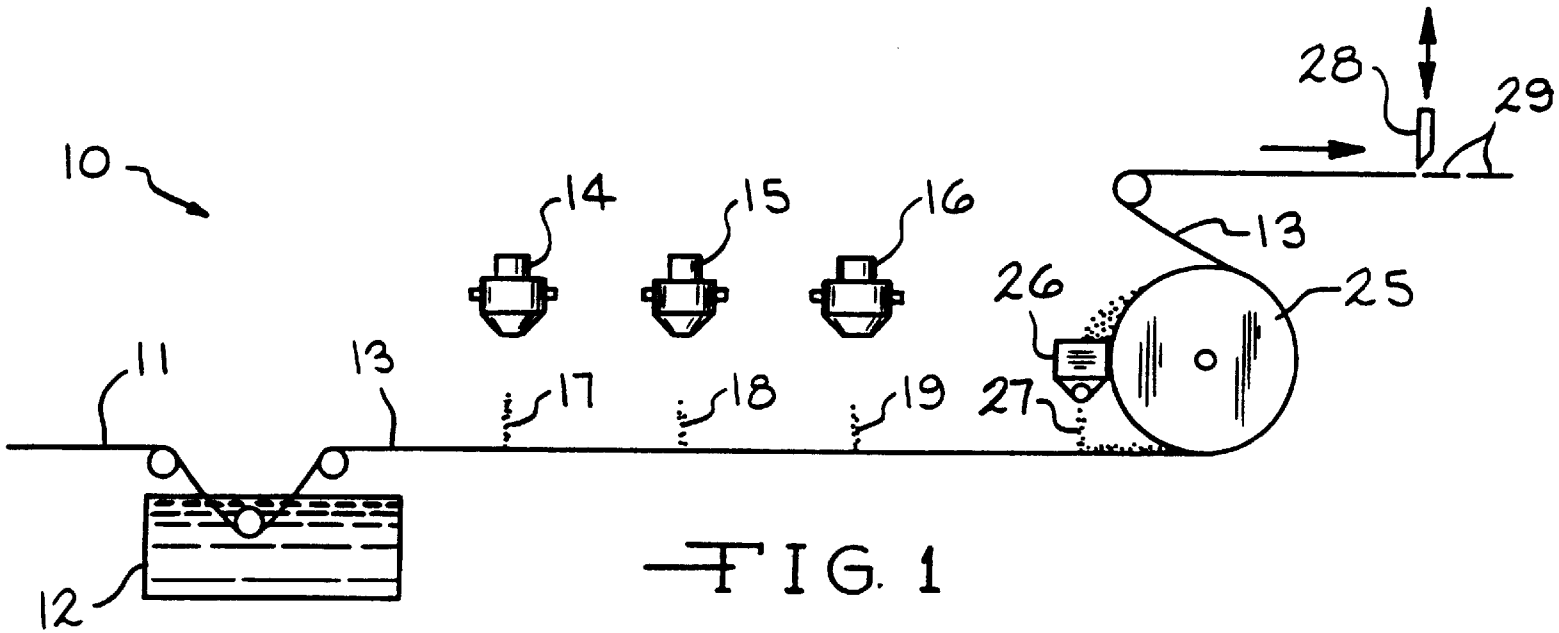
FIG. 1 is a schematic view in elevation of apparatus for forming granule deposits on a moving asphalt coated sheet according to the invention.

Referring now to the drawings, FIG. 1 illustrates a portion of apparatus 10 for manufacturing roofing shingles according to a preferred embodiment of the invention. While the invention is described in relation to roofing shingles, it should be understood that the invention is applicable to any type of asphalt sheet material, such as roll roofing, roofing shingles with or without cutouts, or other forms of asphalt sheet material.

In the illustrated embodiment, a continuous sheet 11 of a glass fiber mat or an organic felt mat is passed through a coater 12 containing hot, liquid asphalt material. This produces a tacky, asphalt coated sheet 13. The sheet then passes beneath a series of granule applicators 14, 15 and 16. The term "granule applicator", as used herein" includes any means suitable for discharging a blend drop of first granules and second granules onto the asphalt coated sheet, to form a granule deposit having an inner portion of first granules and an outer portion of second granules. The granule applicator can be a nozzle, a tube, or any other suitable means.

The granule applicators periodically discharge blend drops 17, 18 and 19 of granules onto the sheet. The granule applicators can be controlled by a controller (not shown), preferably in a programmable manner. Depending on the desired pattern, the granule applicators can be sequenced on and off, and they can be programmed differently or the same. The frequency of the discharge of blend drops from the granule applicators can be changed depending on the desired frequency of the pattern. Also, the position of the granule applicators relative to the prime portion of the sheet can be different or the same. A preferred granule applicator will be described in more detail below.

Figure 2:
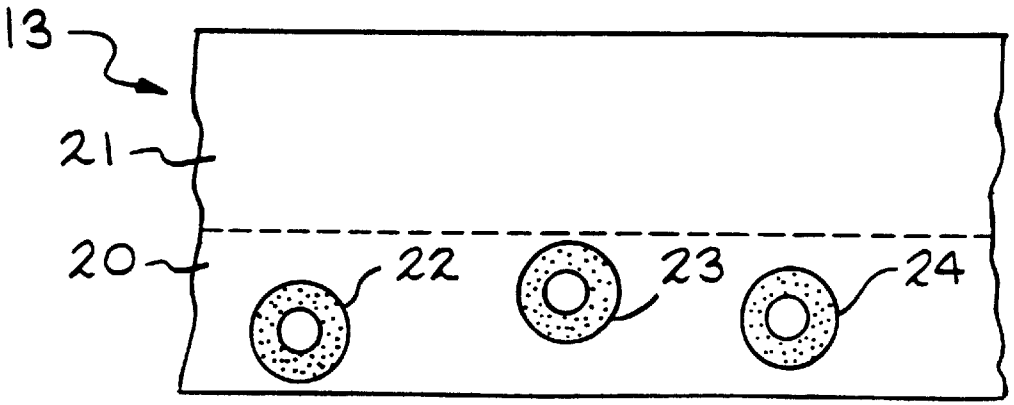
FIG. 2 is a schematic plan view of a portion of an asphalt coated sheet having a series of granule deposits formed thereon according to the invention.

As shown in FIG. 2, the sheet 13 includes a prime portion 20 and a headlap portion 21. Some of the discharged granules adhere to the tacky asphalt coating and form a pattern of granule deposits 22, 23 and 24 on the prime portion of the sheet. The granule deposits can be formed in a staggered or random pattern as shown, or a more regular pattern. Some of the discharged granules do not adhere to the sheet, such as granules which land on top of other granules instead of the tacky asphalt coating. The sheet 13 then passes over a slate drum 25 which presses the granules into the tacky asphalt coating and inverts the sheet sufficiently for non-adhering granules to fall into a hopper 26.

Preferably, the hopper recycles the blend of non-adhering granules by discharging them back onto the sheet as background granules 27. However, the background granules can also be supplied separately and discharged from another hopper onto the sheet. The background granules can be a blend of the granules used to form the granule deposits, or they can be a different kind of granules. Optionally, any of the granules can also be used as headlap granules. A series of granule deposits could also be formed on an asphalt coated sheet without applying background granules. In some methods, background granules are applied to portions of the sheet before applying the granules used to form the granule deposits.

In the illustrated embodiment, the background granules 27 adhere to the tacky asphalt coating in the areas of the sheet 13 not covered by the granule deposits 22, 23 and 24. From the drum 25, the sheet passes through a conventional cooling section (not shown) and a cutter 28 which cuts the sheet into individual shingles 29.

Figure 3:
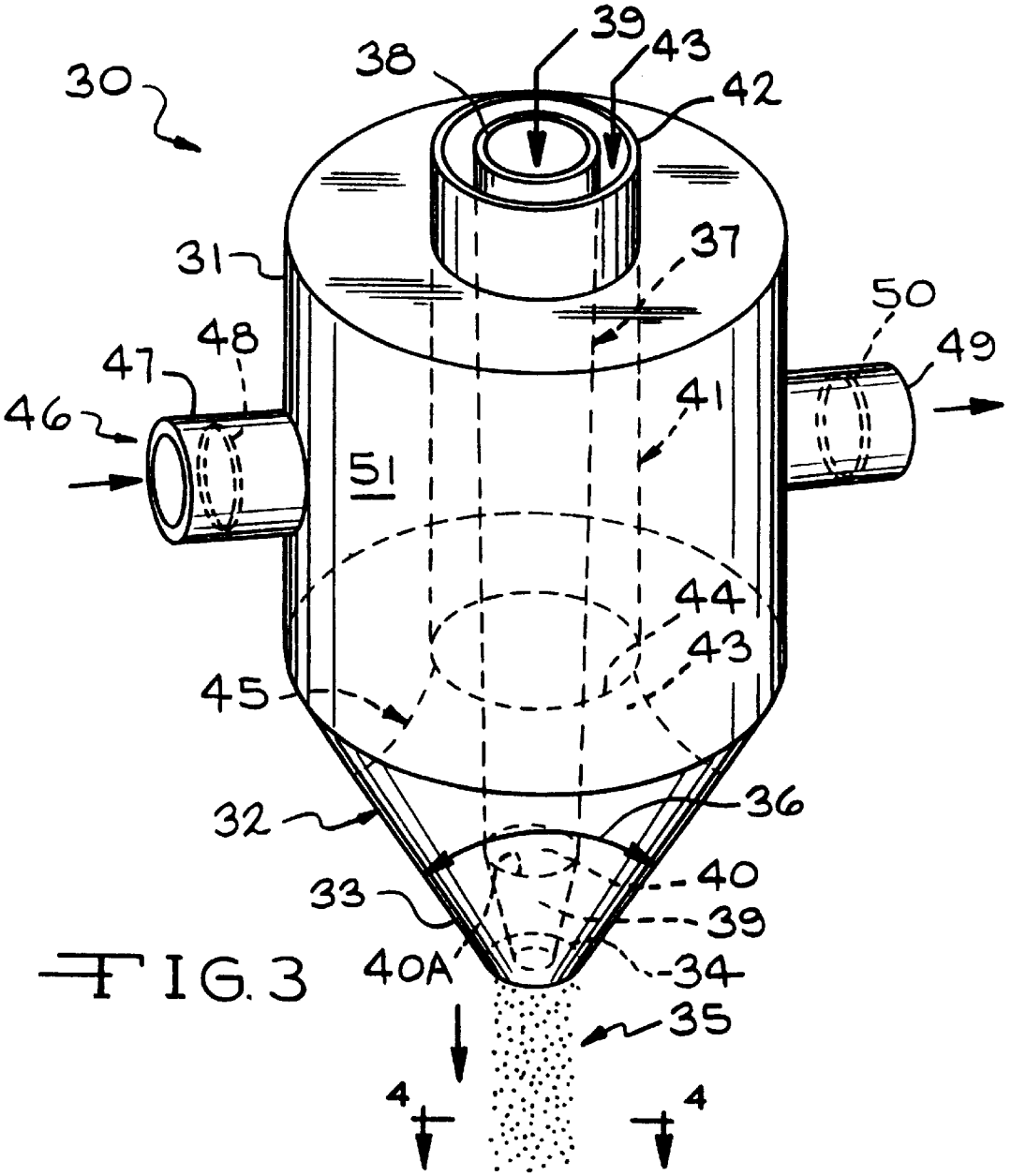
FIG. 3 is a perspective view in elevation of a pneumatic blend drop applicator for discharging a blend drop of first and second granules onto an asphalt coated sheet according to the invention.

As shown in FIG. 3, a specially designed pneumatic blend drop applicator 30 is a preferred granule applicator for use in discharging the blend drops. The pneumatic blend drop applicator is mounted by any means above the asphalt coated sheet. The pneumatic blend drop applicator includes a hollow, generally cylindrical housing 31. A hollow nozzle 32 is provided at the lower end of the housing. Preferably, the nozzle is generally conical in shape, including a tip portion 33. An orifice 34 is formed in the tip portion of the nozzle for discharging a blend drop 35 of first and second granules. The illustrated orifice is generally circular in shape, but the shape of the orifice can be changed to produce different shaped granule deposits on the sheet.

The tip portion 33 of the nozzle 32 defines an angle 36 which is preferably between about 40° and about 140°, and more preferably between about 40° and about 70°. The angle of the tip portion affects the shape of the granule deposit.

Preferably, the nozzle is replaceable to facilitate changing the shape of the orifice or the angle of the tip portion.

A first granule feed chamber 37 is mounted inside the housing. Preferably, the first granule feed chamber is a generally cylindrical first tube. The first granule feed chamber includes an input end 38 positioned near the upper end of the housing. First granules 39 are supplied from any source (not shown) into the input end of the first granule feed chamber. The first granule feed chamber also includes an output end 40. The first granules are fed through the output end of the first granule feed chamber into the nozzle 32. The output end of the first granule feed chamber defines an opening 40A. The shape of the opening affects the shape of the deposit to a somewhat lesser extent than the shape of the nozzle. Preferably, the opening has generally the same shape as the nozzle to best control the shape of the granule deposit.

A second granule feed chamber 41 is also mounted inside the housing. Preferably, the second granule feed chamber is a generally cylindrical second tube. The second granule feed chamber includes an input end 42 positioned near the upper end of the housing. Second granules 43 are supplied from any source into the input end of the second granule feed chamber. The second granule feed chamber also includes an output end 44. The second granules are fed through the output end of the second granule feed chamber into the nozzle 32.

The first granules 39 and second granules 43 form a pile or accumulation 45 of granules in the nozzle. The first granule feed chamber 37 and the second granule feed chamber 41 are positioned so that the first granules are fed inside the second granules in the nozzle. In the illustrated embodiment, the first granule feed chamber is positioned inside the second granule feed chamber. Preferably, the first granule feed chamber is generally coaxial with the second granule feed chamber.

The positioning of the output end 40 of the first granule feed chamber 37 can be varied to affect the shape of the deposit on the sheet. Preferably, the output end of the first granule feed chamber extends a distance past the output end 44 of the second granule feed chamber 41 and into the nozzle 32. However, the output end of the first granule feed chamber can also be located at another position, such as even with the output end of the second granule feed chamber.

The pneumatic blend drop applicator 30 also includes a pneumatic gating mechanism, indicated generally at 46. The pneumatic gating mechanism includes a pressure port 47 for the inflow of pressurized air from any type of pressurized air source (not shown). A pressure solenoid valve 48 is positioned inside the pressure port for opening and closing the pressure port in order to start and stop the inflow of pressurized air. The pressurized air flows inside the hollow cylindrical housing 31 and into the nozzle 32 of the pneumatic blend drop applicator.

The pneumatic gating mechanism also includes a vacuum port 49 for the outflow of air from the housing 31. The vacuum port is connected to any type of vacuum source (not shown) for applying a vacuum. A vacuum solenoid valve 50 is positioned inside the vacuum port for opening and closing the vacuum port in order to start and stop the vacuum. The pressure solenoid valve 48 and vacuum solenoid valve 50 can be positioned at any location suitable for starting and stopping the air pressure and vacuum, respectively.

The interior of the housing 31 defines a buffer chamber 51 between the pressure port 47 and the vacuum port 49. The buffer chamber is positioned adjacent to the accumulation 45 of first and second granules in the nozzle. In operation, when the pressure port is turned on and the vacuum port is turned off, pressurized air flows into the buffer chamber and increases the air pressure within the chamber. The force of the increased air pressure and gravity on the accumulation of granules causes a blend drop 35 of granules to be ejected through the orifice 34 of the nozzle.

By "eject", as used herein, is meant that the blend drop of granules is discharged by a force greater than the force of gravity. The blend drop of granules is forcefully propelled, preferably relatively rapidly. Ejecting the blend drop of granules onto the sheet allows a desired shape of granule deposit to be obtained when the sheet is moving rapidly. If the blend drop is dropped by gravity alone under such conditions, the resulting granule deposit may be undesirably elongated. The blend drop can be ejected by any means, such as mechanically or electrostatically, but preferably the blend drop is ejected pneumatically as described above.

When the pressure port 47 is turned off and the vacuum port 49 is turned on, the air pressure in the buffer chamber 51 is reduced. As a result, air flows from outside the pneumatic blend drop applicator 30 through the orifice 34 and upward through the accumulation 45 of granules in the nozzle 32. The upward flow of air provides an upwardly oriented drag force on the granules in contrast to the downward pull of gravity on the granules. The proper amount of vacuum is applied to the buffer chamber so that the drag force from the upward flow of air balances the pull of gravity on the granules. This holds the granules in place and stops the downward flow of granules from the nozzle. By quickly cycling the pressure and vacuum valves 48, 50, different shapes and lengths of blend drops 35 can be achieved.

If too much vacuum is applied so that the upward velocity of the air flow through the accumulation of granules exceeds a critical level, then the granules could become fluidized and begin to move as if they were caught in a fluid medium. The fluidization of the granules within the nozzle could create undesirable churning and mixing, or the granules could be pulled through the vacuum port. Consequently, the amount of vacuum is balanced to stop the flow of granules without causing fluidization.

A controller (not shown) can be connected to the pneumatic blender to control the application of pressure and vacuum. Any type of controller can be used, such as a computer or similar device. Preferably, the controller is programmable so that instructions can be entered for repeatably producing the desired pattern of granule deposits. In addition to starting and stopping the flow of granules, the air pressure in the buffer chamber can also be varied to increase or decrease the amount and velocity of the flow. For example, the flow rate of the granules can be changed to compensate for a change in the speed of the asphalt coated sheet, so that the granule deposits look the same at different speeds. Alternatively, the air pressure may be varied while discharging the blend drops to form varying patterns of granule deposits.

Figure 4:
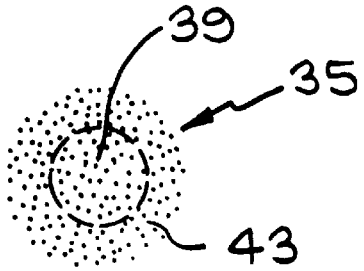
FIG. 4 is a cross-sectional view of the blend drop taken along line 4—4 of FIG. 3, showing an inner portion of first granules and an outer portion of second granules.

As shown in FIG. 4, the resulting blend drop 35 comprises a flow of the first granules 39 inside a flow of the second granules 43. In the illustrated embodiment, the blend drop is generally circular in cross section. However, a variety of blend drop shapes can be formed depending on the shape of the orifice and other factors.

Figure 5:
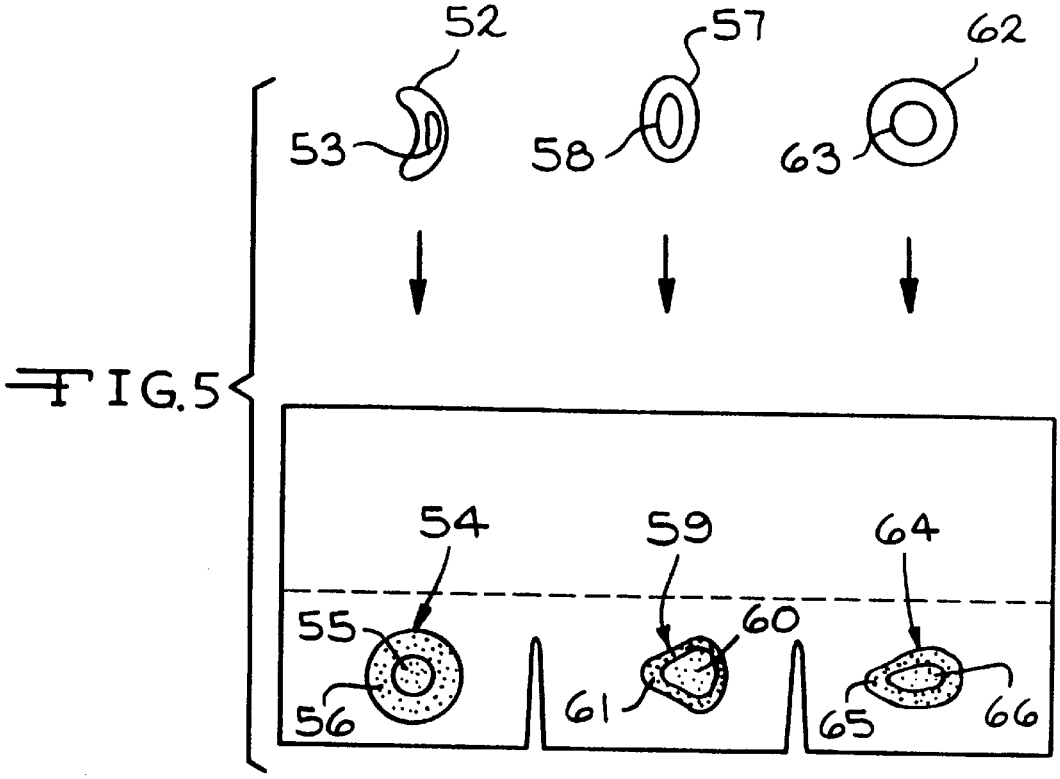
FIG. 5 is a schematic plan view of different shapes of orifices for use in the pneumatic blend drop applicator of FIG. 3, and the different shapes of granule deposits produced by the different orifices, each granule deposit including an inner portion of first granules and an outer portion of second granules.

FIG. 5 illustrates different shapes of orifices for use with a granule applicator such as the pneumatic blend drop applicator 30, and the resulting granule deposits formed when the orifices are used. The views shown indicate the results obtained at typical speeds of the asphalt coated sheet. The shapes of the granule deposits will usually change with changes in the speed of the sheet. Typically, the shapes of the granule deposits are generally symmetrical in the machine direction.

The orifice 52 shown in FIG. 5 is generally crescent-shaped. Preferably, the opening 53 of the first granule feed chamber is also generally crescent-shaped. It can be seen that the resulting granule deposit 54 is generally circular in shape, including an inner portion 55 of first granules and an outer portion 56 of second granules. The inner portion and outer portion are generally concentric circles.

The orifice 57 shown in FIG. 5 is generally oval-shaped. Preferably, the opening 58 of the first granule feed chamber is also generally oval-shaped. It can be seen that the resulting granule deposit 59 is generally teardrop-shaped, including an inner portion 60 of first granules and an outer portion 61 of second granules.

The orifice 62 shown in FIG. 5 is generally circular-shaped. Preferably, the opening 63 of the first granule feed chamber is also generally circular-shaped. It can be seen that the resulting granule deposit 64 is generally teardrop-shaped, including an inner portion 65 of first granules and an outer portion 66 of second granules. The granule deposit 64 is somewhat longer and narrower than the granule deposit 59, and has more first granules at the leading edge of the granule deposit.

Orifices having other shapes can also be used to produce granule deposits of many different shapes on the asphalt coated sheet.

Figure 6:
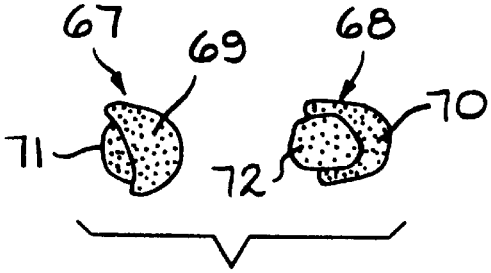
FIG. 6 is a schematic plan view of two alternate embodiments of granule deposits according to the invention, in which the outer portion of second granules does not surround the inner portion of first granules.

In each of the above-described examples, the granule deposit includes an outer portion of second granules which completely surrounds an inner portion of first granules. However, in some embodiments of the invention, the outer portion does not surround the inner portion. For example, FIG. 6 illustrates a pair of granule deposits 67, 68 according to the invention in which the outer portion of second granules 69, 70 does not completely surround the inner portion of first granules 71, 72.

The first granules and second granules for use in the invention can be any kind of granules, such as roofing granules, that are different from one another in some manner. Some of the possible differences include: different color, different size, different shape, different type of granule (e.g., different types of natural rock granules, or natural rock granules and ceramic coated granules), different resistance to microorganisms, different aging properties, or different shading properties. Preferably, the first and second granules are different in color.

Figure 7:
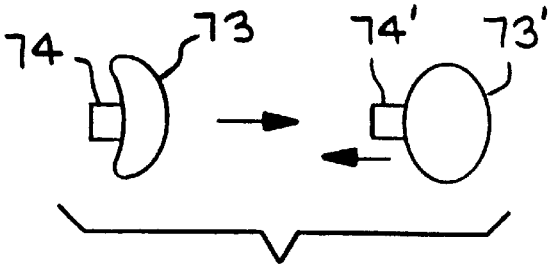
FIG. 7 is a schematic plan view of an elastomeric orifice being adjusted to change its shape from a crescent-shaped orifice to an oval-shaped orifice.

FIG. 7 illustrates an adjustable orifice 73 for use in the nozzle of a granule applicator for making granule deposits of the invention. The orifice is formed of a flexible material such as an elastomeric material. A tab 74 or similar structure is connected to the orifice. The tab is adapted for movement relative to the orifice. For example, the tab can be connected to an air supply which causes its movement under the direction of a controller. Mechanical means or any other suitable means can also be used to move the tab. The movement can be programmable or random. As shown in FIG. 7, when the tab 74' has moved to the left, the original shape of the orifice has changed from a crescent shape 73 to an oval shape 73'. The shape of the orifice can be changed while discharging a blend drop to achieve unique granule deposits. Alternatively, the shape of the orifice can be changed between production runs to accommodate changes in the speed of the sheet or other conditions.

It should be understood that, although the method of forming a granule deposit according to the invention has been described in relation to a preferred pneumatic blend drop applicator, other types of granule applicators can also be used. The nozzle of the granule applicator can be generally linear or elongated in shape, instead of generally conical, and the orifice can be generally rectangular or elongated in shape. Although the illustrated embodiment includes three granule applicators, any desired number can be used (e.g., from one to four or more). Any suitable means can be used for discharging the blend drop of granules.

The invention includes all different shapes of granule deposits, so long as the deposit includes an inner portion of first granules and an outer portion of second granules. For example, a granule deposit according to the invention can include other portions of granules in addition to the inner and outer portions. Further, the inner and outer portions are typically adjacent to one another, but they can also be spaced apart. FIG. 8 illustrates an embodiment of the invention in which the inner and outer portions are not adjacent. A granule applicator 75 includes a nozzle 76 and a deflector 77 positioned in the end of the nozzle. First granules 78 are discharged through an opening in the center of the deflector. Second granules 79 are deflected outward by the deflector. The resulting pattern 80 of granules includes an inner portion 81 of first granules, a ring 82 of background granules surrounding the inner portion, and an outer portion 83 of second granules.

The principle and mode of operation of this invention have been described in its preferred embodiment. However, it should be noted that this invention may be practiced otherwise than as specifically illustrated and described without departing from its scope.

What is claimed is:

1. An apparatus for forming a pattern of granules on a moving asphalt coated sheet comprising:

a nozzle having an orifice for discontinuously discharging a blend drop of first granules and second granules onto the sheet, a first granule feed chamber for feeding first granules into the nozzle, and a second granule feed chamber generally coaxial with the first granule feed chamber for feeding second granules into the nozzle, wherein the first and second granule feed chambers are positioned so that the first granules are discharged from the nozzle in a first stream and at least partially surrounded by a second stream of second granules discharged from the nozzle.

2. The apparatus according to claim 1 wherein the first granule feed chamber is positioned generally coaxially inside the second granule feed chamber.

3. The apparatus according to claim 1 wherein the first and second granule feed chambers are first and second tubes.

4. The apparatus according to claim 1 wherein the first granule feed chamber has an opening for feeding the first granules into the nozzle, and the opening of the first granule feed chamber has generally the same shape as the orifice of the nozzle.

5. The apparatus according to claim 1 wherein the nozzle is generally conical in shape including a tip portion having the orifice for discharging the blend drop of granules, and the tip portion defines an angle between about 40° and about 140°.

6. The apparatus according to claim 1 wherein the apparatus includes a pressure/vacuum gating mechanism which is controlled by a programmable controller.

7. The apparatus according to claim 1 wherein the orifice is adapted for changing its shape.

8. The apparatus according to claim 7 wherein the shape of the orifice is controlled by a programmable controller.

9. An apparatus for forming a pattern of granules on a moving asphalt coated sheet comprising:

a nozzle having an orifice for discontinuously discharging a blend drop of first granules and second granules onto the sheets, a first granule feed chamber for feeding first granules into the nozzle, and a second granule feed chamber generally coaxial with the first granule feed chamber for feeding second granules into the nozzle, wherein the first and second granule feed chambers are positioned so that the first granules are discharged from the nozzle in a first stream and at least partially surrounded by a second stream of second granules discharged from the nozzle; and a buffer chamber for communicating air with the granules in the nozzle to start and stop flow of first and second granules from the nozzle.

10. The apparatus according to claim 9 wherein the apparatus includes a pressure/vacuum gating mechanism in communication with the buffer chamber to start and stop granule flow from the nozzle.

11. The apparatus according to claim 10 wherein the first granule feed chamber has an opening for feeding the first granules into the nozzle, and the opening of the first granule feed chamber has generally the same shape as the orifice of the nozzle.

12. The apparatus according to claim 11 wherein the nozzle is generally conical in shape including a tip portion having the orifice for discharging the blend drop of granules, and the tip portion defines an angle between about 40° and 140°.

13. The apparatus according to claim 9 wherein the orifice is adapted for mechanically changing its shape.

14. The apparatus according to claim 13 wherein the apparatus includes a pressure/vacuum gating mechanism in communication with the buffer chamber to start and stop granule flow from the nozzle.

* * * * *